US006925862B2

(12) United States Patent
Fujita et al.

(10) Patent No.: US 6,925,862 B2
(45) Date of Patent: Aug. 9, 2005

(54) ENGINE OXYGEN CONCENTRATION SENSOR MOUNTING STRUCTURE

(75) Inventors: Hiroyuki Fujita, Wako (JP); Katsuhiko Kawanaka, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/189,802

(22) Filed: Jul. 8, 2002

(65) Prior Publication Data

US 2003/0024299 A1 Feb. 6, 2003

(30) Foreign Application Priority Data

Jul. 11, 2001 (JP) ..... 2001-211008

(51) Int. Cl.[7] ..... G01M 15/00
(52) U.S. Cl. ..... 73/118.1; 73/23.31
(58) Field of Search ..... 73/23.31, 23.32, 73/116, 117.2, 117.3, 118.1

(56) References Cited

U.S. PATENT DOCUMENTS 4,484,440 A * 11/1984 Oki et al. ..... 60/276
5,454,259 A * 10/1995 Ishii et al. ..... 73/118.1
5,535,135 A * 7/1996 Bush et al. ..... 702/24
5,941,918 A * 8/1999 Blosser ..... 701/29
6,082,103 A * 7/2000 Sugiura et al. ..... 60/323
6,092,368 A * 7/2000 Ishii et al. ..... 60/277
6,591,817 B2 * 7/2003 Deutsch ..... 123/525
6,601,444 B2 * 8/2003 Ohmori et al. ..... 73/118.1
6,725,655 B2 * 4/2004 Yoshirawa et al. ..... 60/323
2002/0069643 A1 * 6/2002 Yoshizawa et al. ..... 60/323
2002/0134362 A1 * 9/2002 Deutsch ..... 123/575

* cited by examiner

*Primary Examiner*—Eric S. McCall
(74) *Attorney, Agent, or Firm*—Armstrong, Kratz, Quintos, Hanson & Brooks, LLP

(57) ABSTRACT

An engine oxygen concentration sensor mounting structure in which an oxygen concentration sensor is mounted in a collector exhaust pipe connected to an outlet of an exhaust manifold having a plurality of exhaust single pipes. When a straight line is drawn from a detection part of the oxygen concentration sensor positioned within the collector exhaust pipe so as to be parallel to a section of a centerline of the exhaust pipe closest to the detection part, the straight line passes outside the outlet of the exhaust manifold. This allows the exhaust gases discharged from the exhaust manifold to be sufficiently mixed within the curved exhaust pipe and differences in length of the plurality of the exhaust single pipes to be compensated for. Thus, accurate detection by the oxygen concentration sensor can be secured, even if the lengths of a plurality of exhaust single pipes of the exhaust manifold are nonuniform.

3 Claims, 10 Drawing Sheets

ENGINE OXYGEN CONCENTRATION SENSOR MOUNTING STRUCTURE

BACKGROUND OF THE INVENTION

1. Field of the Invention

The present invention relates to an engine oxygen concentration sensor mounting structure in which an oxygen concentration sensor is mounted in an exhaust pipe connected to an outlet of a collector exhaust manifold of an engine.

2. Description of the Related Art

Conventionally known is a technique of detecting the oxygen concentration of an exhaust gas from an engine by an oxygen concentration sensor and controlling the amount of fuel injected into the engine based on the detected oxygen concentration. In a conventional multicylinder engine, an oxygen concentration sensor is generally provided in a collector exhaust pipe connected to the downstream side of a combined part of an exhaust manifold. In this case, it is known that equalizing the lengths of a plurality of exhaust single pipes forming the exhaust manifold can balance the contribution levels of the exhaust gases discharged from each of the combustion chambers, thereby enhancing the accuracy in detecting the oxygen concentration.

In a multicylinder engine in which the crankshaft is placed widthwise in the lateral direction in an engine compartment, it is comparatively easy to equalize the lengths of a plurality of exhaust single pipes. However, in a multicylinder engine in which the crankshaft is placed lengthwise in the longitudinal direction, an exhaust single pipe extending to a combustion chamber on the front side of the vehicle body inevitably becomes long, and an exhaust single pipe extending to a combustion chamber on the rear side of the vehicle body inevitably becomes short. As a result, when an oxygen concentration sensor is provided in a collector exhaust pipe connected to the downstream side of the combined part of an exhaust manifold, variations are produced in the levels contributed to the oxygen concentration by the exhaust gases discharged from the combustion chambers, leading to a problem of degradation of the accuracy in detection of the oxygen concentration.

SUMMARY OF THE INVENTION

The present invention has been carried out in view of the above-mentioned circumstances, and it is an object of the present invention to ensure accurate detection by an oxygen concentration sensor provided in an exhaust pipe on the downstream side of an exhaust manifold even when the lengths of a plurality of exhaust single pipes thereof are nonuniform.

In order to accomplish the above-mentioned object, in accordance with a first aspect of the present invention, there is proposed an engine oxygen concentration sensor mounting structure in which an oxygen concentration sensor is mounted in a collector exhaust pipe connected to an outlet of an exhaust manifold of an engine, wherein the oxygen concentration sensor is mounted in the curved collector exhaust pipe extending to the outlet of the exhaust manifold, which has a plurality of exhaust single pipes, and when a straight line is drawn from a detection part of the oxygen concentration sensor positioned within the collector exhaust pipe so as to be parallel to a section of a centerline of the collector exhaust pipe closest to the detection part, the straight line passes outside the outlet of the exhaust manifold.

In accordance with this arrangement, because the oxygen concentration sensor is mounted in the curved collector exhaust pipe extending to the outlet of the exhaust manifold and, when a straight line is drawn from the detection part of the oxygen concentration sensor so as to be parallel to the section of the centerline of the collector exhaust pipe closest to the detection part, this straight line passes outside the outlet of the exhaust manifold, the exhaust gases discharged from the exhaust manifold can be adequately mixed within the curved collector exhaust pipe, thus compensating for differences in the lengths of the plurality of exhaust single pipes and thereby ensuring accurate detection by the oxygen concentration sensor. The adequate mixing of the exhaust gases within the collector exhaust pipe can be achieved by the exhaust gases impinging on the inner wall of the curved exhaust pipe and being diffused, where the inner wall faces the outlet of the exhaust manifold.

Furthermore, in accordance with a second aspect of the present invention, there is proposed an engine oxygen concentration sensor mounting structure wherein the oxygen concentration sensor is mounted on the inside of the curve of the collector exhaust pipe.

In accordance with this arrangement, because the oxygen concentration sensor is mounted on the inside of the curve of the collector exhaust pipe, the oxygen concentration sensor can be placed by effectively utilizing the dead space formed by the curve in the collector exhaust pipe, thereby enhancing space efficiency. Moreover, it is possible to secure working space for the oxygen concentration sensor to be installed and removed, thereby enhancing ease of maintenance.

Moreover, in accordance with a third aspect of the present invention, there is proposed an engine oxygen concentration sensor mounting structure wherein the engine is mounted in a vehicle, and the oxygen concentration sensor is disposed on the front side of the collector exhaust pipe.

In accordance with this arrangement, because the oxygen concentration sensor is disposed on the front side of the collector exhaust pipe, the oxygen concentration sensor can be cooled by the passage of air as the vehicle travels, thereby enhancing durability.

The above-mentioned object, other objects, characteristics and advantages of the present invention will become apparent from an explanation of a preferred embodiment that will be described in detail below by reference to the attached drawings.

BRIEF DESCRIPTION OF THE DRAWINGS

FIGS. 1 to 10 show a preferred exemplary embodiment of the present invention, where FIG. 1 is a front view of a V-type eight-cylinder engine;

FIG. 2 is a view from arrow 2 in FIG. 1;

FIG. 3 is an exploded view corresponding to FIG. 2;

FIG. 4 is a cross section along line 4—4 in FIG. 1;

FIG. 5 is a cross section along line 5—5 in FIG. 4;

FIG. 6 is a cross section along line 6—6 in FIG. 2;

FIGS. 8A and 7B are unit diagrams of a second cover half;

FIG. 9 is a cross section along line 9—9 in FIG. 1; and

DESCRIPTION OF THE PREFERRED EXEMPLARY EMBODIMENT

Figure 1:
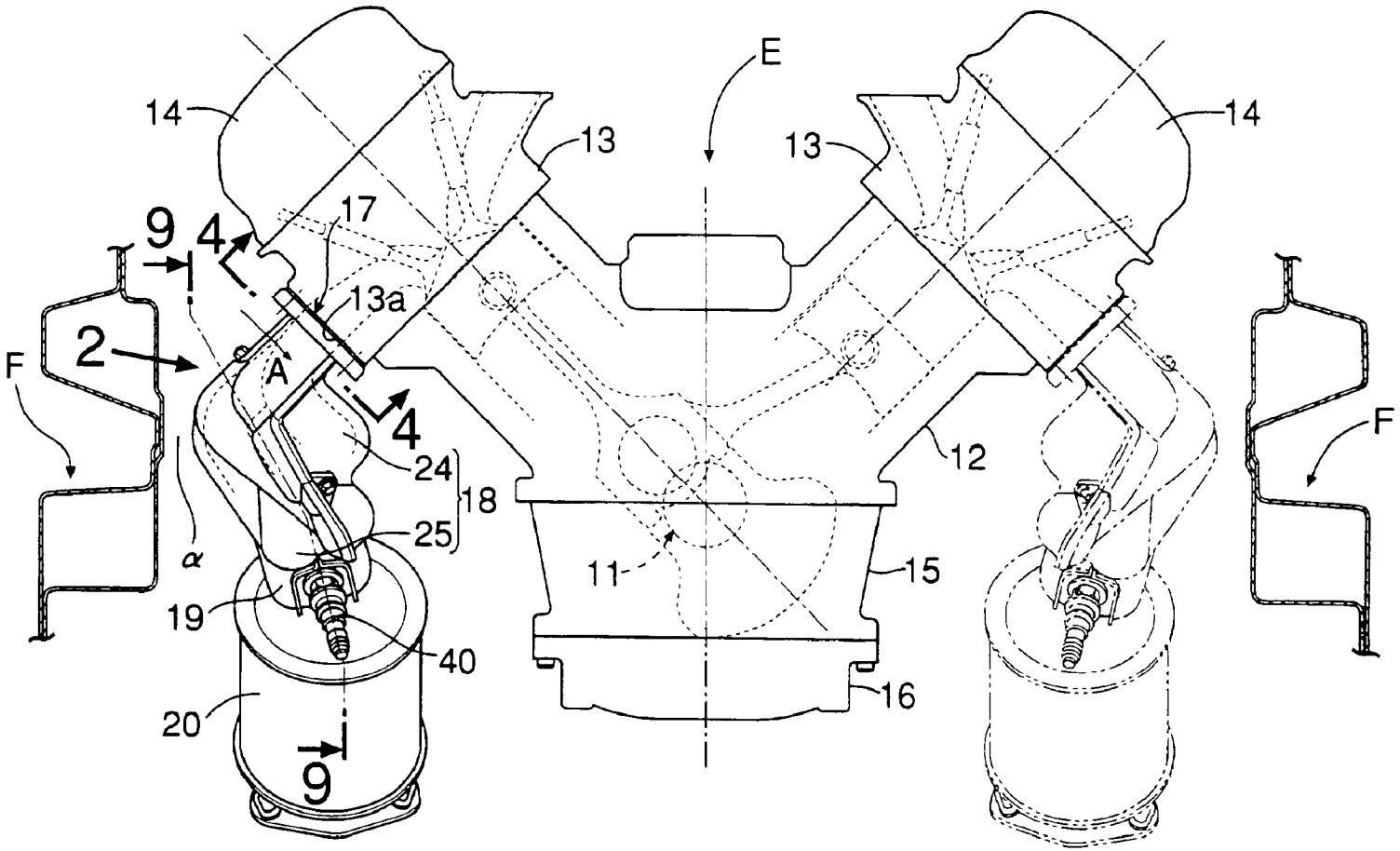
Figure 2:
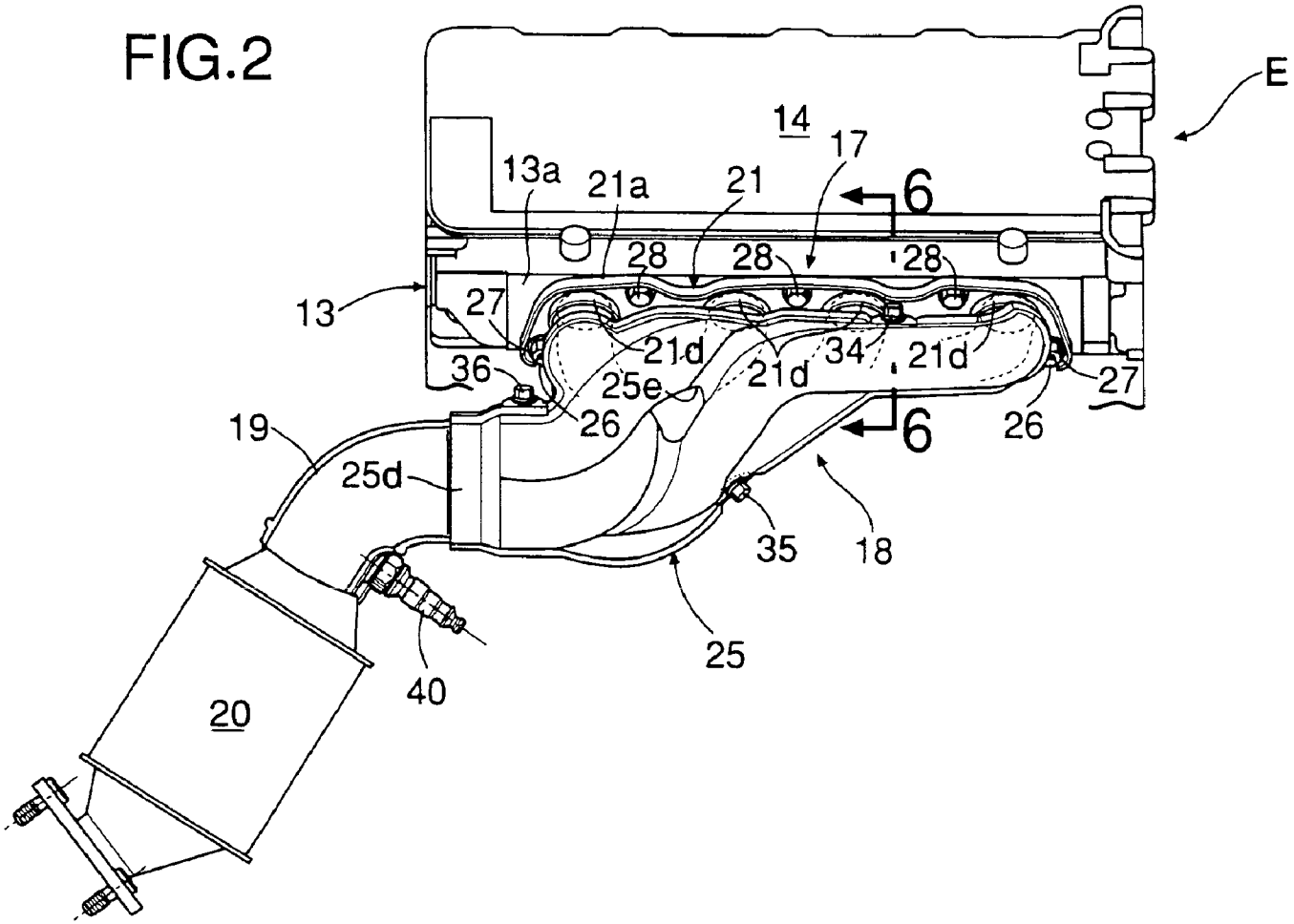
Figure 3:
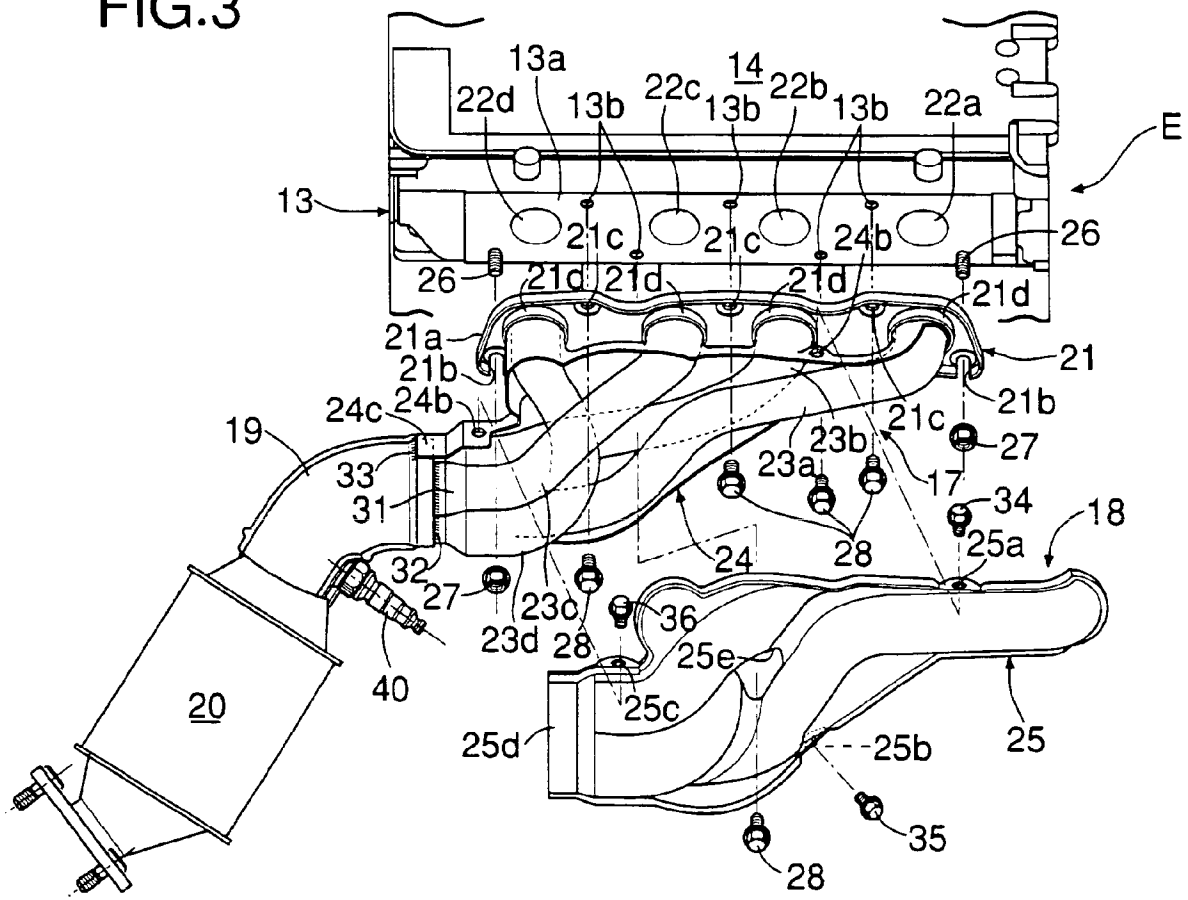
Figure 4:
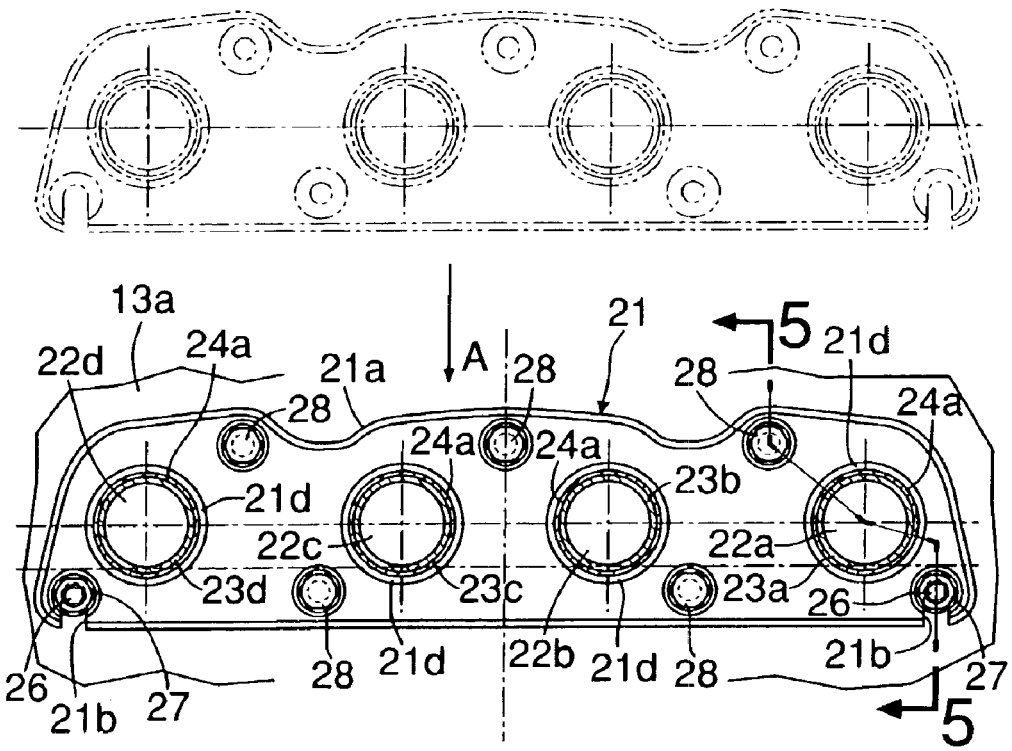
Figure 5:
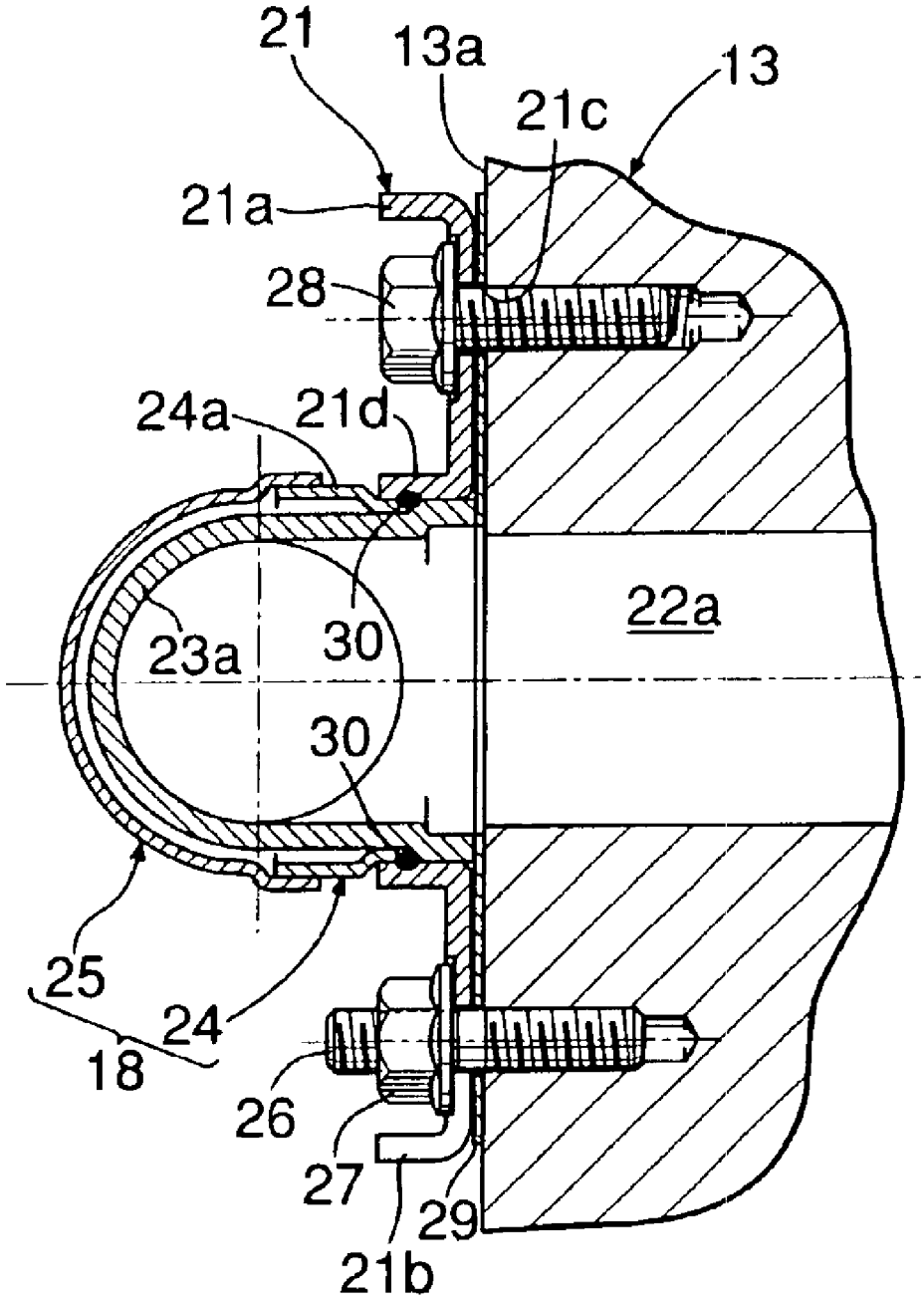
Figure 6:
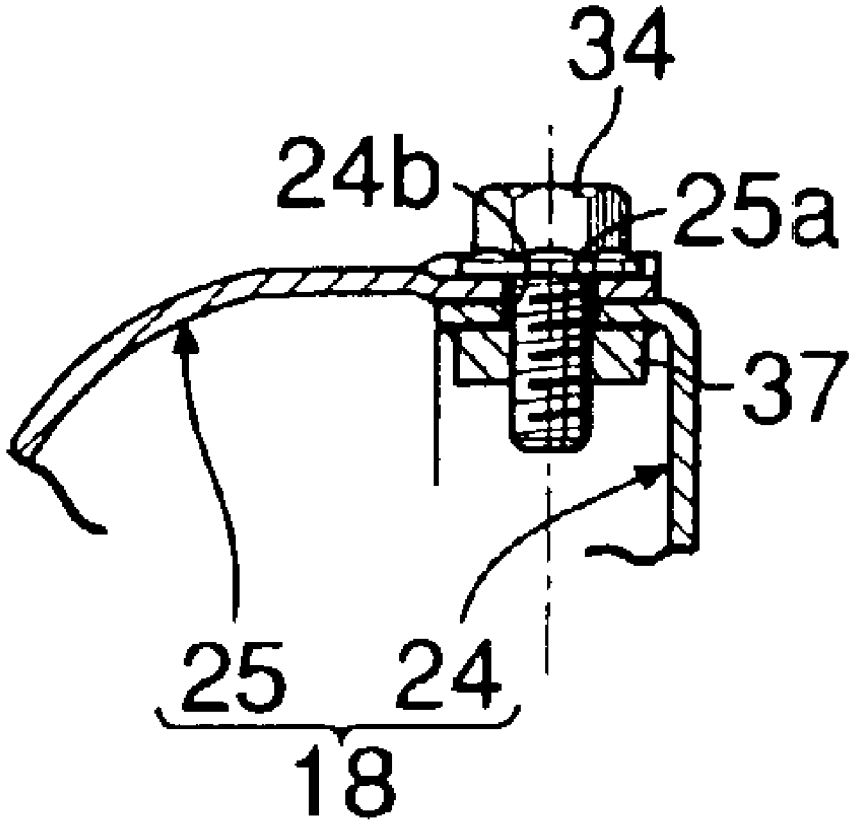
Figure 7A:
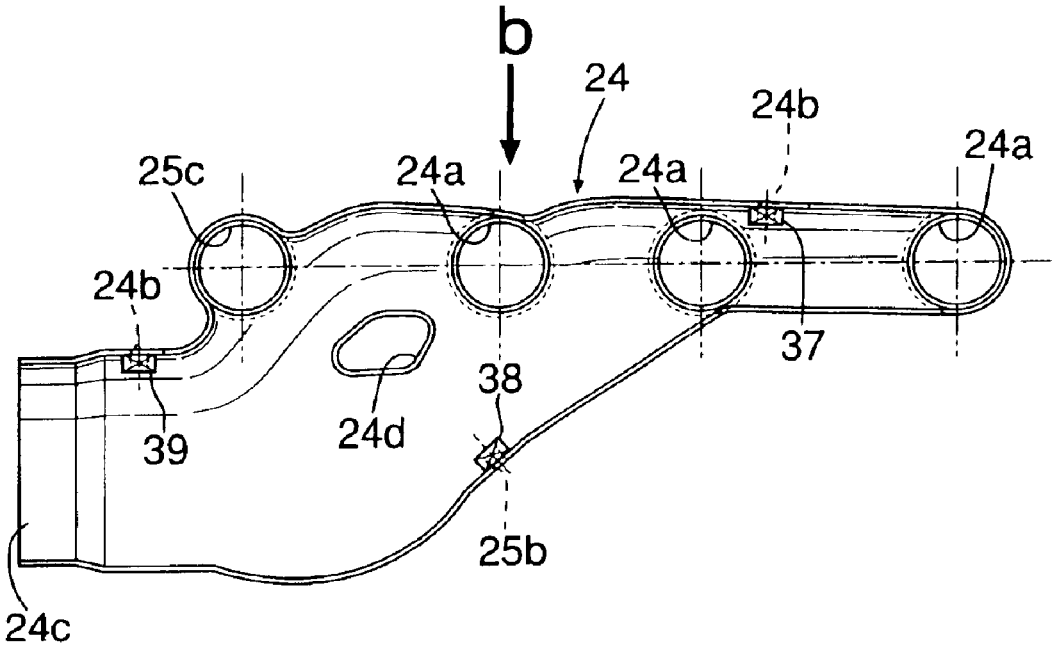
FIGS. 7A and 7B are unit diagrams of a first cover half.
Figure 7B:
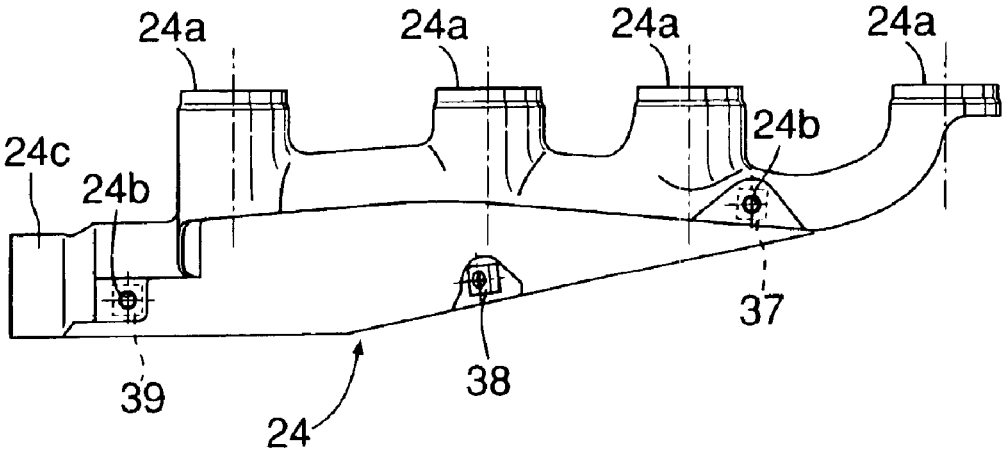
Figure 8A:
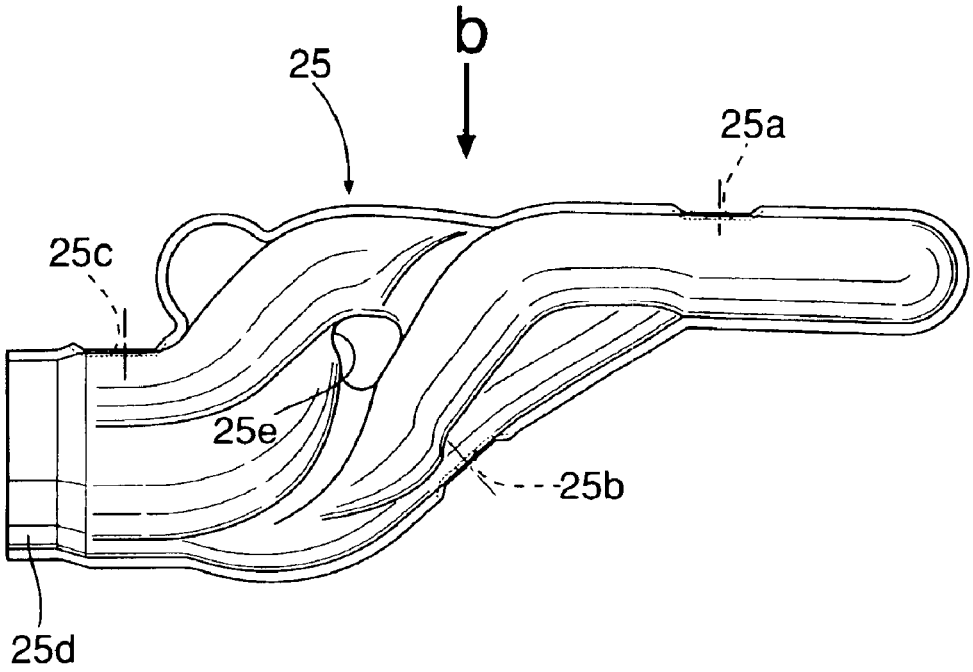
Figure 8B:
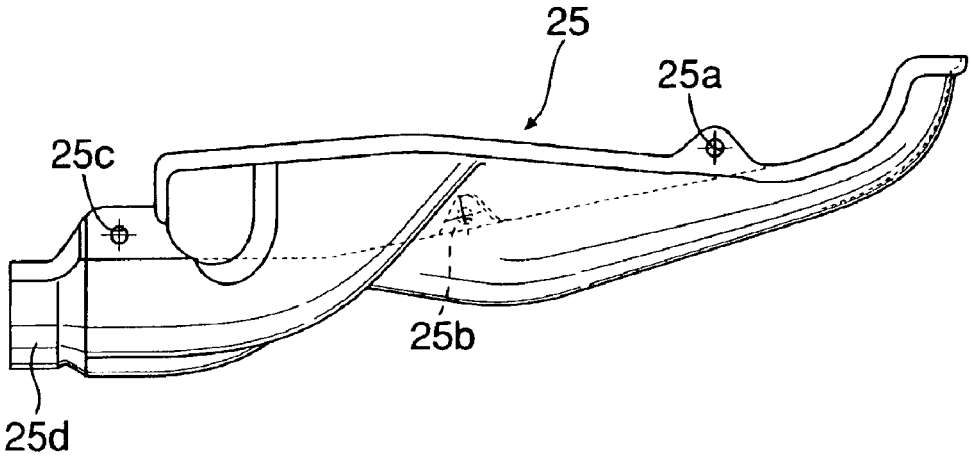

Referring to FIG. 1, a V-type eight-cylinder engine E is mounted lengthwise in an engine compartment of an automobile so that a crankshaft 11 is disposed in the longitudinal direction of a vehicle body. The engine E includes a V-type cylinder block 12, a pair of left and right cylinder heads 13 joined to the upper faces of the cylinder block 12, a pair of left and right head covers 14 joined to the upper faces of the two cylinder heads 13, a crankcase 15 joined to the lower face of the cylinder block 12, and an oil pan 16 joined to the lower face of the crankcase 15. Joined to mounting faces 13*a* of the left and right cylinder heads 13 are exhaust manifolds 17, which are enclosed by covers 18. Underneath-type exhaust gas catalytic purification devices 20 are joined to the downstream of the left and right exhaust manifolds 17 via short collector exhaust pipes 19. Left and right front side frames F are disposed in the longitudinal direction so as to be in the proximity of the outer sides of the left and right exhaust manifolds 17 and the covers 18. Because the left and right exhaust systems have a symmetric structure relative to the vehicle body centerline, the structure of the exhaust system on the right of the vehicle body is explained as the representative thereof.

As shown in FIGS. 2 to 9, the exhaust manifold 17 includes a sheet-form mounting flange 21 joined to the mounting face 13*a* of the cylinder head 13, and four exhaust single pipes 23*a* to 23*d* communicating with four exhaust ports 22*a* to 22*d*, respectively, opening on the mounting face 13*a*. The cover 18 includes a first cover half 24 integrated with the exhaust manifold 17, and a second cover half 25 detachably fixed to the first cover half 24.

Formed on the mounting face 13*a* of the cylinder head 13 are at least two (two in the embodiment) stud bolts 26 and a plurality of (five in the embodiment) threaded holes 13*b*. Formed on the outer periphery of the mounting flange 21 of the exhaust manifold 17 are a reinforcing rib 21*a* projecting outward (in a direction away from the cylinder head 13), two notches 21*b* corresponding to the two stud bolts 26, and five through holes 21*c* corresponding to the five threaded holes 13*b*. The two notches 21*b* are provided on opposite ends, in the longitudinal direction, of a lower part of the mounting flange 21 and open downward, and there are breaks in the reinforcing rib 21*a* in these parts.

The mounting flange 21 is thus secured to the cylinder head 13 by means of two nuts 27 screwed onto the two stud bolts 26 and five bolts 28 running through the through holes 21*c* of the mounting flange 21 and screwed into the threaded holes 13*b* in the mounting face 13*a* with a gasket 29 (see FIG. 5) disposed between the mounting flange 21 and the cylinder head 13.

Four outwardly projecting annular reinforcing ribs 21*d* are formed on the mounting flange 21 of the exhaust manifold 17 at positions corresponding to the exhaust ports 22*a* to 22*d* of the cylinder head 13. Four annular parts 24*a* on the inner end of the first cover half 24 are fitted into the inner circumferences of the four reinforcing ribs 21*d*. Further, the upstream ends of the four exhaust single pipes 23*a* to 23*d* are fitted into the inner circumferences of the annular parts 24*a*, and joined together as a unit by welds 30 (see FIG. 5). The four exhaust single pipes 23*a* to 23*d* are merged at their downstream ends to form a combined part 31, and the combined part 31 is joined by a weld 32 (see FIGS. 3 and 9) to the upstream end of the collector exhaust pipe 19, and a semi-cylindrical part 24*c* formed on the outer end of the first cover half 24 is joined by a weld 33 in the vicinity of the weld 33 (see FIG. 3). The first cover half 24 is positioned so as to cover the inner face of the exhaust manifold 17, that is, the face on the engine E side.

The second cover half 25 covers the face of the exhaust manifold 17 on the front side frame F side and is detachably fixed to the first cover half 24 by three bolts 34, 35 and 36. The three bolts 34, 35 and 36 run through three through holes 25*a*, 25*b*, and 25*c*, respectively, of the second cover half 25 and through the through holes 24*b* of the first cover half 24, and are screwed into weld nuts 37, 38, and 39, respectively, on the inner surface of the first cover half 24 (see FIG. 6). A semi-cylindrical part 25*d* formed on the outer end of the second cover half 25 encloses the upstream end of the collector exhaust pipe 19 in cooperation with the semi-cylindrical part 24*c* of the first cover half 24 in a state in which the second cover half 25 and the first cover half 24 are joined together. The first cover half 24 and the second cover half 25 have apertures 24*d* and 25*e*, respectively, and one of the five bolts 28 securing the mounting flange 21 to the cylinder head 13 is attached and detached through the apertures 24*d* and 25*e*.

Figure 9:
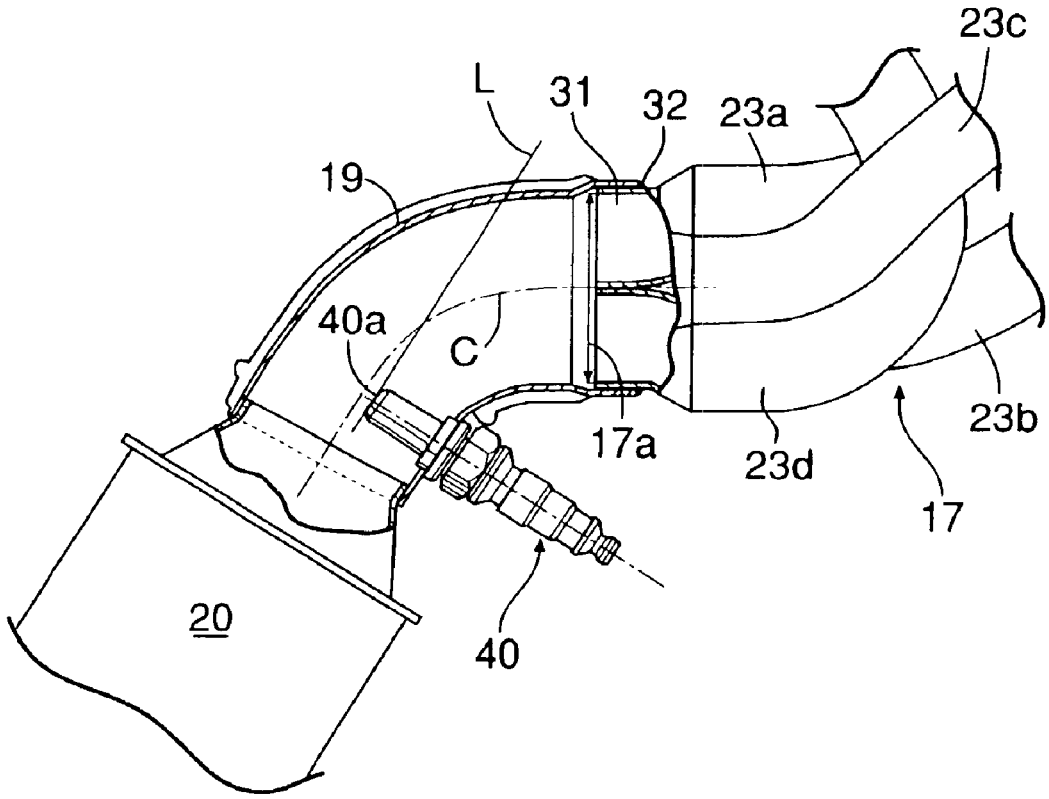

As is clear from FIG. 9, the collector exhaust pipe 19 bends through approximately 60° and is equipped, on the inside of the curve, with an oxygen concentration sensor 40 for detecting the oxygen concentration in the exhaust gas. When a straight line L is drawn from a detection part 40*a* at the extremity of the oxygen concentration sensor 40 so as to be parallel to a section of a centerline C of the collector exhaust pipe 19 closest to the detection part 40*a*, the straight line L is outside the confines of the outlet 17*a* on the downstream end of the exhaust manifold 17. In other words, the collector exhaust pipe 19 bends greatly, and the oxygen concentration sensor 40 is disposed at a position on the downstream side of the collector exhaust pipe 19. As is clear from FIG. 1, the oxygen concentration sensor 40 is provided on the front side face of the collector exhaust pipe 19, that is, in a position that is most efficiently exposed to the passage of air when the vehicle is traveling.

When installing the exhaust manifold 17 on the engine E mounted in the vehicle body, because the front side frame F is positioned in the proximity of the side of the cylinder head 13, the exhaust manifold 17 cannot be installed by moving it in a direction perpendicular to the mounting face 13*a* of the cylinder head 13. In the present embodiment, the exhaust manifold 17 is firstly moved from the rear to the front so as to be inserted between the cylinder head 13 and the front side frame F, and then moved downward so that the mounting flange 21 of the exhaust manifold 17 moves along the mounting face 13*a* of the cylinder head 13 (see arrows A in FIGS. 1 and 4). In this way, the two notches 21*b* opening downward in the mounting flange 21 engage with the two stud bolts 26 of the cylinder head 13, thereby provisionally fixing the exhaust manifold 17 to the cylinder head 13. In this state, screwing the nuts 27 onto the two stud bolts 26, running the five bolts 28 through the through holes 21*c* of the mounting flange 21, and screwing them into the threaded holes 13*b* of the cylinder head 13 can secure the exhaust manifold 17 to the cylinder head 13.

Because the exhaust manifold 17 can thus be secured to the cylinder head 13 by moving it in a direction along the mounting face 13*a* of the cylinder head 13 without moving it in a direction perpendicular to the mounting flange 13*a*, the exhaust manifold 17 can be installed on the cylinder head 13 without interfering with the front side frame F. Furthermore, because the exhaust manifold 17 can be provisionally fixed to the cylinder head 13 by engaging the notches 21*b* of the mounting flange 21 with the stud bolts 26 of the cylinder head 13, the subsequent operation of screwing the nuts 27 onto the bolts 28 can be carried out easily.

Moreover, not only can the exhaust manifold 17 be stably supported by the stud bolts 26 because the notches 21*b* open downward, but also the exhaust manifold 17 can be supported more stably because the notches 21*b* are formed on opposite ends of the mounting flange 21. Furthermore, because the stud bolts 26 and the threaded holes 13*b* are positioned so as to surround the outside of the annular parts 24*a* of the first cover half 24, which is welded integrally with the mounting flange 21 of the exhaust manifold 17, the nuts 27 and the bolts 28 can be screwed together without interference from the first cover half 24. Moreover, because the four exhaust single pipes 23*a* to 23*d* are completely covered from their inlets with the cover 18, it is possible to effectively prevent heat radiating from the exhaust gas and reduce the exhaust noise.

The exhaust manifold 17 can be detached by reversely following the above-mentioned installation procedure. Also in this case, it is possible to prevent the exhaust manifold 17 from interfering with the front side frame F.

Furthermore, because the reinforcing rib 21*a* provided on the outer periphery of the mounting flange 21 of the exhaust manifold 17 projects in a direction away from the cylinder head 13, the heat radiated in the vertical direction from the exhaust single pipes 23*a* to 23*d* through which high temperature exhaust gas flows, can be blocked by the reinforcing rib 21*a*, thereby enhancing the durability of the gaskets disposed between the cylinder block 12 and the cylinder head 13 and between the cylinder head 13 and the head cover 14. Moreover, because the reinforcing rib 21*a* extends to positions next to the notches 21*b* of the mounting flange 21, it is possible to minimize any reduction in rigidity of the mounting flange 21 caused by formation of the notches 21*b*.

Furthermore, although the part of the cover 18 covering the lower side and the side next to the vehicle body of the exhaust manifold 17 (that is, the second cover half 25) is easily corroded due to the attachment of water and mud, because the second cover half 25 is detachable from the first cover half 24, which is integral with the exhaust manifold 17, it is possible to exchange only the corroded second cover half 25, thereby economizing on maintenance costs.

Figure 10A:
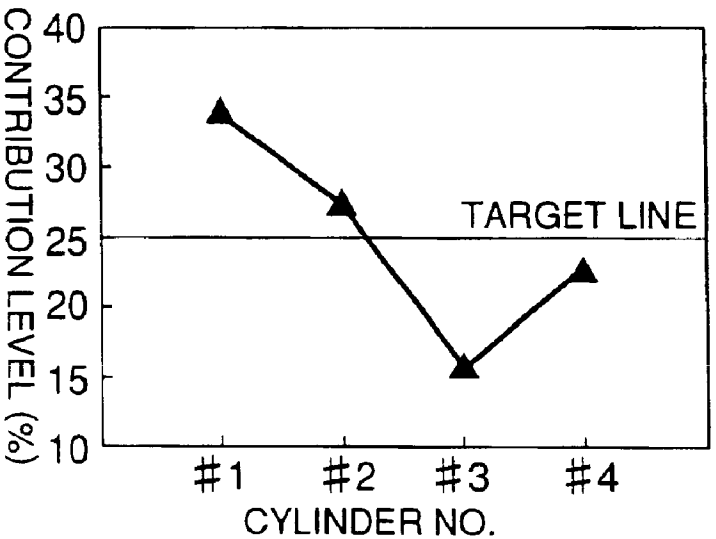
FIGS. 10A and 10B are graphs showing the influence of the exhaust gases discharged from four exhaust ports on the value of the oxygen concentration detected.

Exhaust gases flow from the four exhaust single pipes 23*a* to 23*d* into the collector exhaust pipe 19 equipped with the oxygen concentration sensor 40 and, ideally, the exhaust gases discharged from the four exhaust ports 22*a* to 22*d* each should have a contribution level of 25% to the oxygen concentration. However, as shown in FIG. 10A, in the conventional type, the influence on the value detected by the oxygen concentration sensor 40 by each of exhaust single pipes 23*a* to 23*d* varies, and it has been difficult to precisely detect the oxygen concentration. The reason is that when a V-type eight-cylinder engine E is placed lengthwise, the lengths of the four exhaust single pipes 23*a* to 23*d* inevitably differ, and if the position at which the oxygen concentration sensor 40 is mounted or the shape of the collector exhaust pipe 19 on which it is mounted are inappropriate, the exhaust gases supplied from the four exhaust single pipes 23*a* to 23*d* to the collector exhaust pipe 19 do not act equally on the oxygen concentration sensor 40.

Figure 10B:
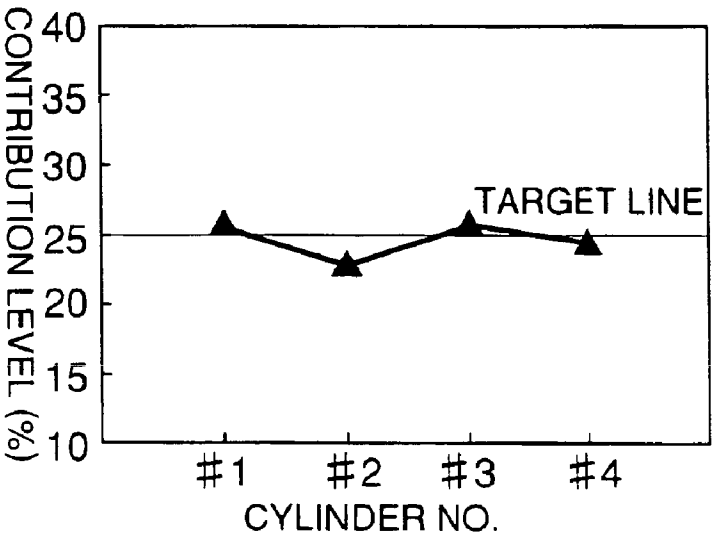

In order to eliminate such a problem, it is necessary to make the exhaust gases flowing in from the four exhaust single pipes 23*a* to 23*d* impinge on the inner wall of the collector exhaust pipe 19 so as to adequately mix them before they act on the oxygen concentration sensor 40 by increasing the curvature of the collector exhaust pipe 19 and providing the oxygen concentration sensor 40 on the downstream side of the collector exhaust pipe 19. As hereinbefore described, the degree of curvature of the collector exhaust pipe 19 and the position where the oxygen concentration sensor 40 is mounted in order to satisfy the above-mentioned requirement are such that, when the straight line L is drawn from the detection part 40*a* at the extremity of the oxygen concentration sensor 40 so as to be parallel to the section of the centerline C of the collector exhaust pipe 19 closest to the detection part 40*a*, the straight line L is outside the confines of the outlet 17*a* on the downstream end of the exhaust manifold 17 (see FIG. 9). Satisfying this condition can bring the levels contributed to the oxygen concentration by the exhaust gases discharged from the four exhaust ports 22*a* to 22*d* close to 25% each, as shown in FIG. 10B.

Because the oxygen concentration sensor 40 is provided on the inside of the curve of the exhaust pipe 19, the oxygen concentration sensor 40 can be positioned by effectively utilizing the dead space on the inside of the curve of the collector exhaust pipe 19. Moreover, it is possible to ensure that there is space for a tool for attaching and removing the oxygen concentration sensor 40 to be operated, thereby enhancing the ease of maintenance. Furthermore, because the oxygen concentration sensor 40 is provided in the position on the front side of the collector exhaust pipe 19, the position being most efficiently exposed to the passage of air, the oxygen concentration sensor 40 can be effectively cooled, thereby enhancing its durability.

Although the present invention is explained in detail above, the present invention can be modified in a variety of ways without departing from the spirit and scope of the present invention.

For example, a V-type eight-cylinder engine E is illustrated in the embodiment, but the present invention can be applied to a V-type engine having a different number of cylinders or an in-line multicylinder engine.

Furthermore, the present invention is most effectively applied to an engine E that is mounted lengthwise in a vehicle, but it can also be applied to an engine other than a vehicle engine or an engine that is mounted widthwise in a vehicle.

What is claimed is:

1. An engine oxygen concentration sensor mounting structure in which, for each inline bank of cylinders in an engine, an oxygen concentration sensor is mounted in a collector exhaust pipe connected to an outlet of an exhaust manifold, said exhaust manifold comprising a plurality of exhaust single pipes which include ones of different lengths and converge into the collector exhaust pipe, wherein the oxygen concentration sensor is mounted in a curve of the collector exhaust pipe extending to the outlet of the exhaust manifold, the curve of the collector exhaust pipe being positioned immediately downstream of the outlet of the exhaust manifold, and when a straight line is drawn from a detection part of the oxygen concentration sensor positioned within the collector exhaust pipe so as to be parallel to a section of a centerline of the collector exhaust pipe closest to the detection part, the straight line passes outside the outlet of the exhaust manifold, and wherein the engine is mounted in a vehicle, an exhaust gas catalytic purification device is connected to the collector exhaust pipe, and the oxygen concentration sensor is disposed in a position upstream of the exhaust gas catalytic purification device in a passage of air generated when the vehicle is traveling.

2. The engine oxygen concentration sensor mounting structure according to claim 1, wherein the oxygen concentration sensor is mounted on the inside of the curve of the exhaust pipe.

3. The engine oxygen concentration sensor mounting structure according to either claim 1 or 2, wherein the oxygen concentration sensor is disposed on a front side of the collector exhaust pipe.

* * * * *